US009783927B2

(12) United States Patent
Sorrentino et al.

(10) Patent No.: US 9,783,927 B2
(45) Date of Patent: Oct. 10, 2017

(54) AIR HOOD FOR A YANKEE ROLL AND SYSTEM COMPRISING A YANKEE ROLL AND SAID AIR HOOD

(71) Applicant: A. CELLI PAPER S.P.A., Capannori (IT)

(72) Inventors: Salvatore Sorrentino, Pinerolo (IT); Mauro Celli, Lucca (IT); Giuseppe Antonini, Lido di Camaiore (IT)

(73) Assignee: A. CELLI PAPER S.P.A., Capannori (IT)

( * ) Notice: Subject to any disclaimer, the term of this patent is extended or adjusted under 35 U.S.C. 154(b) by 0 days.

(21) Appl. No.: 15/029,397

(22) PCT Filed: Oct. 13, 2014

(86) PCT No.: PCT/IB2014/065272
§ 371 (c)(1),
(2) Date: Apr. 14, 2016

(87) PCT Pub. No.: WO2015/056155
PCT Pub. Date: Apr. 23, 2015

(65) Prior Publication Data

US 2016/0230336 A1 Aug. 11, 2016

(30) Foreign Application Priority Data

Oct. 15, 2013 (IT) ..... FI2013A0241

(51) Int. Cl.
*D21F 5/18* (2006.01)
*D21F 5/02* (2006.01)

(52) U.S. Cl.
CPC ..... *D21F 5/181* (2013.01); *D21F 5/021* (2013.01)

(58) Field of Classification Search
CPC ..... D21F 5/181; D21F 5/021; D21F 5/18
USPC ..... 162/364
See application file for complete search history.

(56) References Cited

U.S. PATENT DOCUMENTS

| | | | | |
|---|---|---|---|---|
| 3,855,713 | A * | 12/1974 | Portouw | D21F 5/02 34/122 |
| 4,399,169 | A | 8/1983 | McGowan | |
| 5,383,288 | A * | 1/1995 | Ilmarinen | D21F 5/00 34/119 |
| 5,410,819 | A | 5/1995 | Joiner | |
| 6,154,981 | A * | 12/2000 | Heikkila | D21F 5/044 34/114 |
| 7,363,725 | B2 * | 4/2008 | Promitzer | D21F 5/044 34/120 |
| 8,132,338 | B2 * | 3/2012 | Deem | D21F 5/044 162/198 |
| 2006/0107549 | A1 | 5/2006 | Parent et al. | |
| 2016/0222588 | A1 * | 8/2016 | Sorrentino | D21F 5/181 |

FOREIGN PATENT DOCUMENTS

| | | | |
|---|---|---|---|
| DE | 10 2011 088514 | A1 | 6/2013 |
| WO | 99/57367 | A1 | 11/1999 |

* cited by examiner

*Primary Examiner* — Mark Halpern
(74) *Attorney, Agent, or Firm* — McGlew and Tuttle, P.C.

(57) ABSTRACT

The air hood (3) for Yankee rolls (1) comprises at least one supply circuit (5, 6, 7) to supply dry hot air towards outlets (7A) to a working area, and at least one suction circuit (11) to suck wet air from the working area. The hood comprises a thermal insulation insulating at least partially the supply circuit from the suction circuit.

26 Claims, 8 Drawing Sheets

AIR HOOD FOR A YANKEE ROLL AND SYSTEM COMPRISING A YANKEE ROLL AND SAID AIR HOOD

This application is a 371 of PCT/IB2014/065272 filed on 13 Oct. 2014.

TECHNICAL FIELD

The present invention relates to improvements to machines, parts of machines, components and elements of plants for paper production, especially for paper wet production. More in particular, the present invention relates to improvements allowing to save energy in the above mentioned plants, decrease pollutant emissions and reduce heat discharge into the environment. According to some aspects, the invention relates to improvements to the insulation systems of air hoods for Yankee rolls used in paper plants.

STATE OF THE ART

Reducing the energy consumption has always been a crucial issue for some industries, for instance the paper industry.

In paper wet production plants, a layer of aqueous pulp of cellulose fibers is treated so as gradually to remove the water therefrom and dry it around a Yankee roll. The Yankee roll is heated by means of steam flowing inside it. Air hoods are arranged around the Yankee roll, which are provided with a supply system for dry hot air lapping the cellulose ply driven around the Yankee roll. Wet air at lower temperature is sucked from the cellulose ply and removed therefrom, thus removing the humidity from said ply.

High quantity of thermal energy is used to heat both the steam circulating in the Yankee roll and the air circulating in the air hoods.

Currently, the air hoods are provided with insulation systems comprised of rock wool pillows inserted in panels of sheet metal, to reduce the heat losses.

The insulation systems made of this material have the following problems:

- low insulation efficiency, due to the thermal bridges of the panels;
- wear and decay due to the temperature, as over the time the rock wool looses its insulation properties;
- structural distortions, due to the different expansion coefficients of the materials used.

The increased energy costs and the greater environmental responsibility are continuous stimuli to search increasingly effective solutions for consumption reduction, also using innovative products.

SUMMARY OF THE INVENTION

According to a first aspect, an air hood is provided for Yankee rolls, comprising at least one circuit to supply dry hot air towards outlets to a working area, and at least one circuit to suck wet air from the working area. According to some embodiments, the air hood comprises a thermal insulation insulating at least partially the supply circuit from the suction circuit.

This allows several advantages. First of all, the heat exchange is reduced between the dry hot air supplied to the air hood and the wet air extracted from it and returned to a conditioning system, where humidity is removed and thermal energy is added, for instance using a burner. This reduces the heat losses into the environment and thus the energy consumption. The reduction of heat loss by heat exchange between the suction circuit and the supply circuit results in a reduction in the heat input into the environment and in the energy necessary to heat the air to be supplied to the air hood.

Moreover, by reducing the heat exchange between dry hot air and wet air, it is possible to achieve a more uniform temperature profile of the supplied air along the extension of the air hood, i.e. along the axial extension of the Yankee roll, with which the hood is associated. This leads to better results in terms of drying and quality of the finished product.

It is also possible to decrease the temperature of the supplied air.

Thanks to the more uniform temperature along the longitudinal extension of the air hood, there are fewer differences in heat expansion and therefore in stresses due to expansion differentials and this has structural advantages.

The air hood may be comprised of two substantially symmetrical semi-hoods that can open and close to allow accessing the Yankee roll below. Each semi-hood may comprise a supply circuit for supplying dry hot air and a suction circuit for sucking wet air. The two circuits may be substantially symmetrical or functionally equivalent.

In some embodiments, each supply circuit comprises at least one supply duct, distribution boxes for the dry hot air in fluid communication with the supply duct, and inflate channels, supplying dry hot air towards the working area of the air hood, which are in fluid communication with the distribution boxes and are provided with outlets. The inflate channels may be parallel to one another and to the axis of the Yankee roll, with which the air hood is associated. The inflate channels comprise dry hot air outlets allowing the dry hot air to exit towards the working area of the air hood, arranged between the surface of the Yankee roll and said dry hot air outlets.

In practical embodiments, the air hood, or each semi-hood into which the air hood is subdivided, comprises an inner space surrounded by outer walls, where the supply duct and the air distribution boxes are arranged. In some embodiments, the inflate channels are arranged according to a substantially cylindrical surface extending around a portion of the Yankee roll, delimiting the inner space of the air hood along the area facing the cylindrical surface of the Yankee roll. The inflate channels are spaced from one another to define apertures or passages therebetween, through which wet air is sucked from the working area, where the cellulose ply passes, towards the inner space of the air hood and from this latter towards the suction duct.

Dry hot air, supplied from the supply duct, enters the distribution boxes and is delivered therefrom into the inflate channels.

At least one portion of the air supply duct may advantageously be thermally insulated. In advantageous embodiments, at least a part of the walls of the distribution boxes is insulated too. In this way it is possible to reduce the heat exchange between these walls and the inner space of the air hood, where the supply duct and the air distribution boxes are arranged.

In some embodiments, the air hood, or each semi-hood forming the air hood, comprises two front walls, substantially orthogonal to the axis of the Yankee roll with which the air hood is associated. The front walls may be insulated, for instance by means of sheets or plates of thermal insulating material applied onto the outside of support flanks.

The supply duct for the dry hot air and the suction duct for the wet air may pass through one of these front walls.

A preferably curved side wall may be arranged between the two front walls; this side wall together with the front walls delimits the inner space of the hood or semi-hood.

The curved side wall may be provided with a thermal insulation. This insulation may be advantageously comprised of insulation panels aligned to one another. Each panel may comprise a shell for containing one or more sheets or plates of thermal insulating material. Using gaskets, the shell may be water-proof sealed and, if necessary, air-proof sealed. In this way, the plates of thermal insulating material contained inside the panels are protected against the environment humidity and the physical features of the material are therefore better preserved.

In advantageous embodiments the panels may be coupled together to form a self-supporting structure that makes the assembly of the panels easier.

In some embodiments, angular profiles are arranged along one edge of the panels, defining seats where the adjacent panels are joined or coupled together. The members for joining adjacent panels together may be designed such as to leave clearance between consecutive panels, allowing the panel to thermally expand.

The panels may be connected, at the sides, to the flanks of the front walls. This connection may be done using systems allowing transverse heat expansion of the insulation panels, i.e. allowing the panels to lengthen in the direction parallel to the axis of the Yankee roll with which the air hood is associated.

In some embodiments, gaskets may be provided between the edges of the insulation panels and the adjacent front walls; these gaskets avoid or prevent air flow from the inside of the air hood to the outside and vice versa. The gaskets may form, or be associated with, systems for compensating heat expansions.

In some embodiments, auxiliary thermal insulating materials may be provided along the edges of the insulation panels, for instance in the form of strips, that can be sufficiently deformed to compensate for any heat expansion. These auxiliary materials may be for instance strips, pads or pieces of thermal insulating material of carbon foam, preferably sintered carbon foam, advantageously with closed cell for better thermal insulation.

The joints between the flanks of the front walls and the insulation panels forming the curved side wall, as well as the joints between the insulation panels of the curved side wall substantially allow to seal the inner space of the air hood, or else the two inner spaces of the semi-hoods, reducing or eliminating air leakages, especially from the outer environment towards the inner space of the hood, thus increasing the heat efficiency of the hood and reducing heat losses.

The front walls and the panels forming the curved side wall are modular: they can be delivered as single demounted pieces and then assembled on site, thus reducing the transport costs and avoiding the need for special transport means.

Eliminating the rock wool insulation used in the known hoods allows eliminating the environmental impact of this material and the effects thereof for the operator's health.

In some embodiments, a thermal expansion joint may be provided along the or each supply duct for the dry hot air, between the air hood and an air heating unit. The expansion joint may be arranged between two portions of the air supply duct. The expansion joint may be inserted inside respective ends of two consecutive portions, into which the air supply duct is subdivided. A seal gasket may be interposed between the two portions. Said gasket may be inserted in a flange formed by a first portion and a flange formed by a second portion of the supply duct for the dry hot air. In this way the two portions, into which the dry hot air supply duct is subdivided, can move reciprocally, remaining sealed or limiting the leakages of dry hot air into the environment.

Similar arrangements may be provided on the wet air suction duct.

According to a different aspect, an air hood for Yankee rolls is provided, comprising at least one supply circuit to supply dry hot air towards outlets to a working area, and at least one suction circuit to suck wet air form the working area, and outer containment walls defining a space inside which the supply circuit and the suction circuit are at least partially housed. The outer containment walls comprise a thermal insulation. Characteristically, the thermal insulation comprises at least one panel comprising a thermal insulating material, which is contained at least partially in a closed housing and is preferably in the form of insulating sheet or plate. Said housing may be water-proof and, if necessary, also air-proof sealed.

According to a further aspect, the invention provides a system comprising a Yankee roll, around which an air hood as described above is arranged.

According to a further aspect, the invention provides at least some insulating sheets or plates made of a thermal insulating material having a polymeric matrix, where one or more of the following components are dispersed: glass particles, rock wool, clay particles, montmorillonite particles. The thermal insulating material, after having been dried and hardened in a furnace or the like, is preferably applied to a structural element, for instance a sheet metal of an insulation panel or a flank of the air hood.

In some embodiments, the thermal insulating material is shaped in the form of sheets, plates or the like starting from a suspension or a dispersion in a dispersing liquid, typically (although not exclusively) water. The percentage by weight of the starting dry matter, i.e. the matter before addition of the dispersing liquid, may be as follows:

glass spheres 5-40% by weight;
rock wool 5-40% by weight;
clay and/or montmorillonite 0.5-5% by weight
polymer, for instance acrylic polymer, 10-40% by weight.

The single percentages, chosen within the indicated ranges, amount preferably to 100, i.e. the thermal insulating material is formed starting from a composition constituted by the four components indicated above, to which the dispersing liquid is added. The quantity of dispersing liquid to be added is such to achieve the proper viscosity for the specific use, which can be defined by means of traditional optimization criteria known to those skilled in the art. Fire-resistant or flame-retardant compounds, for instance phosphor compounds, may be added to the polymer.

Advantageously the thermal insulating material, after having been solidified and hardened, is substantially without cavities. "Substantially without cavities" means that the hollow space (i.e. the space containing air) inside the material is lower than 10%, preferably lower than 3% and more preferably lower than 2% of the whole volume, thus generating a particularly compact, efficient and temperature-resistant material.

The polymer-based thermal insulating material has reduced thickness, equal for instance to a quarter, with respect to the thickness necessary in the rock wool insulations of the prior art. This allows substantially reducing the weight and the bulk of the insulation system for the outer walls of the hood. This decrease in weight reduces the flexure deformations of the hood structure, and the hood can be therefore made with a lighter structure.

The sheets or plates of polymer-based thermal insulating material may have different thicknesses depending upon the thermal insulation required and/or the temperatures involved, thus adapting the performances of the air hood without the need for changing the general structure thereof.

The insulation of the dry hot air supply ducts and of the distribution boxes may be made of the same polymer-based material or of a material different from that used for the sheets or plates of thermal insulating material that are associated with the outer walls of the air hood and which are relatively rigid. The insulation of the air distribution boxes and/or of the dry hot air supply duct may be made for instance of carbon foam, preferably sintered carbon foam. The foam may be advantageously of the closed-cell type.

In some embodiments, the insulation of the air supply duct and/or of the distribution boxes may be contained in a space between two walls, for instance an inner wall and an outer protective casing, both advantageously made of sheet metal, for instance steel. The casing or outer wall and the inner wall may be made of different types of steel. The fact of arranging the thermal insulation for the air supply duct and/or the air distribution boxes inside a protected space ensures that the chemical-physical and structural features of the insulation are therefore better preserved, thus ensuring a longer life and a better efficiency over time.

The thermal insulation of the supply ducts for the dry hot air and of the distribution boxes supplying the dry hot air from these supply ducts towards the inflate channels allows many advantages in terms of efficiency of the air hoods and energy savings. The insulation of the supply ducts between the burner, where the air is heated, and the air hood reduces heat losses towards the outside, thus reducing or eliminating the temperature difference between the air exiting the burners and the air entering the hood.

The thermal insulation of the air supply ducts in the area contained between the walls of the hood, as well as the insulation of the air distribution boxes supplying the air from these supply ducts towards the inflate channels reduces the heat exchange between the supplied dry hot air and the colder wet air sucked from the area around the Yankee roll through the suction ducts. In this way the heat losses are reduced, as well as the time necessary to bring the air hood into steady-state conditions, with consequent advantages in terms of reduction in thermal power. Moreover, the insulation allows reducing the temperature difference of the dry hot air along the longitudinal extension of the Yankee roll, and this allows achieving a more uniform humidity profile along the width of the paper, finally ensuring a better quality of the finished product.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention will be better understood by means of the description below and the attached drawing, which shows a non-restrictive practical embodiment of the invention. More particularly, in the drawing.

DETAILED DESCRIPTION OF EMBODIMENTS

The detailed description below of example embodiments is made with reference to the attached drawings. The same reference numbers in different drawings identify the equal or similar elements. Furthermore, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

Figure 1:
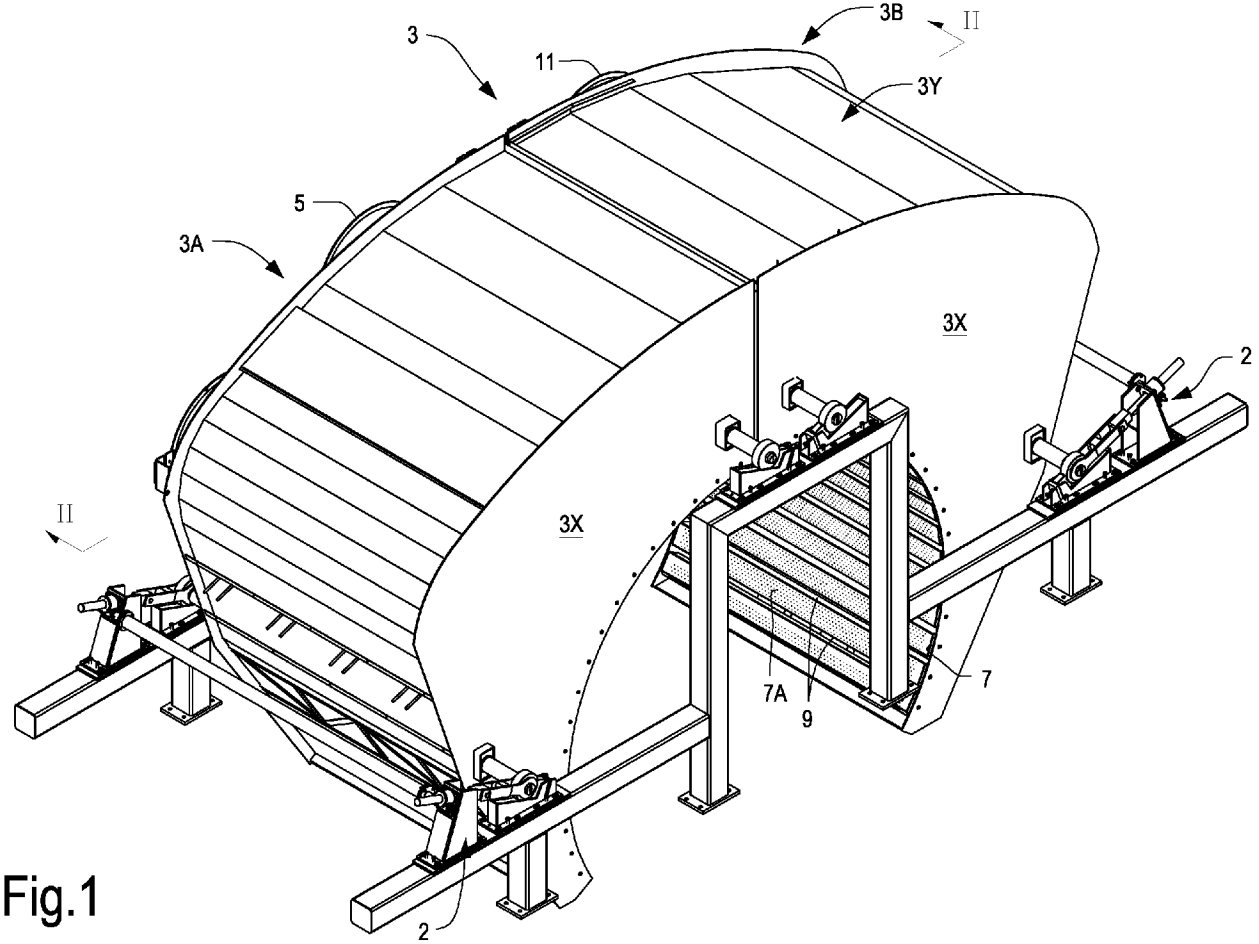
FIG. 1 is an axonometric view of an air hood.
Figure 2:
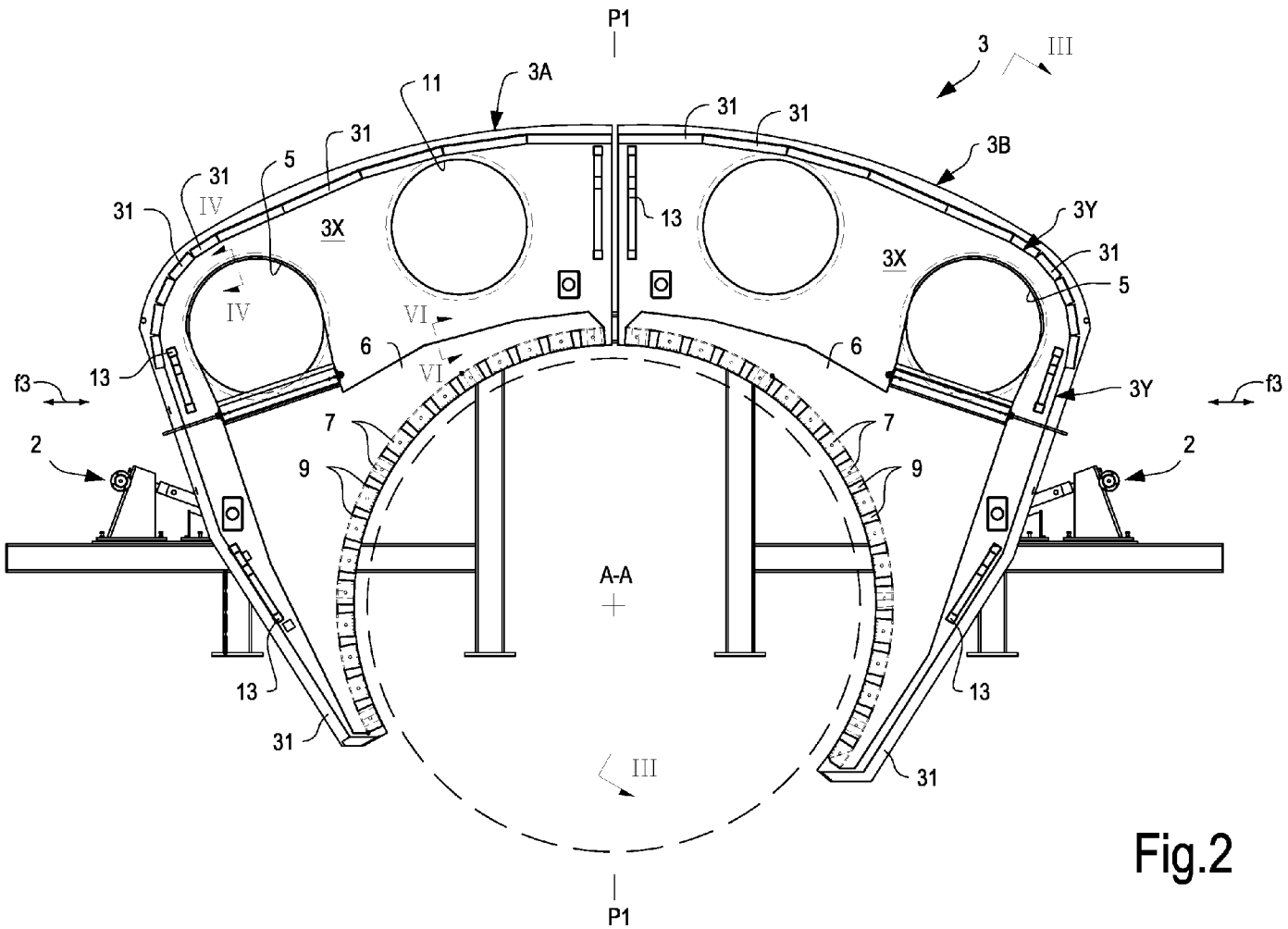
FIG. 2 is a cross-section of the air hood and the corresponding Yankee roll according to II-II of FIG. 1.
Figure 3:
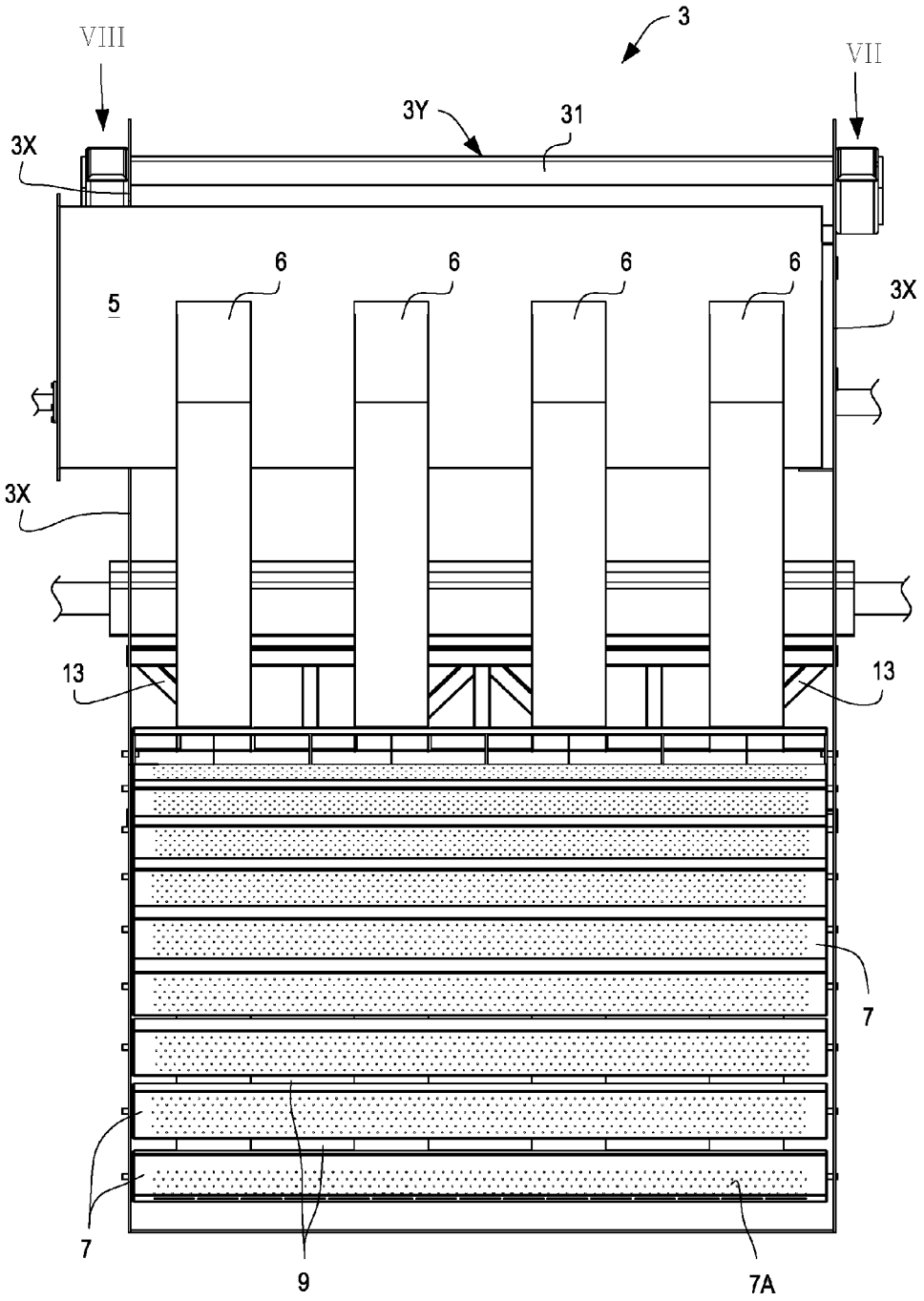
FIG. 3 is a cross-section according to of FIG. 3

In FIGS. 1 to 3 an air hood 3 is shown, arranged around a Yankee roll 1 (generically indicated in FIG. 2); around this roll a cellulose ply is driven, that is dried thanks to the heat emitted from the cylindrical surface of the Yankee roll, with which it is into contact, and thanks to the hot air circulating from the air hood 3 around the Yankee roll 1. Between the cylindrical surface of the Yankee roll 1 and the air hood 3 a working area is defined, wherethrough the cellulose ply driven around the Yankee roll 1 moves.

In some embodiments, the air hood 3 is subdivided into two semi-hoods or semi-bodies 3A and 3B adjacent to each other in correspondence of a vertical median plane P1-P1 containing the axis of rotation A-A of the Yankee roll 1.

The two semi-hoods 3A and 3B move towards and away from each other according to the double arrow f3, so as to allow accessing the Yankee roll 1 below for inspection, maintenance, and cleaning. This movement may be controlled by means of actuators 2 arranged at the sides of the air hoods 3.

Each semi-hood 3A, 3B has a dry hot air supply duct, indicated with number 5 for both the semi-hoods 3A, 3B. The supply ducts 5 are into fluid communication with a plurality of dry hot air distribution boxes 6. Each box 6 is in fluid communication with a plurality of inflate channels 7 supplying dry hot air towards the working area of the air hood 3. The inflate channels 7 are arranged around the cylindrical surface of the Yankee roll 1. The inflate channels 7 extend longitudinally nearly parallel to the axis A-A of the Yankee roll 1. They are substantially arranged according to a nearly cylindrical pattern partially following the extension of the cylindrical wall of the Yankee roll 1.

The inflate channels 7 have dry hot air outlets, schematically indicated with 7A, allowing the dry hot air, supplied by means of the supply ducts 5 and the boxes 6 into the inflate channels 7, to exit towards the cylindrical surface of the Yankee roll 1, and more precisely against the cellulose ply (not shown) driven around the Yankee roll 1. In some embodiments, the inflate channels 7 are spaced from one another so as to leave, between pairs of adjacent inflate channels 7, respective openings or hollow spaces 9, through which wet air is sucked from the cylindrical surface of the Yankee roll 1 and the web material N. The wet air is sucked by means of suction ducts 11 and, dragging therewith humidity removed from the cellulose ply, is conveyed towards a system for removing humidity and heating air. The air, dried and heated again, returns towards the air hood through the supply ducts 5.

In the illustrated embodiment, each semi-hood or semi-body 3A, 3B has only one suction duct 11 in fluid communication with the inner space of the respective semi-hood 3A, 3B, defined between the outer walls of the air hood and the series of inflate channels 7 partially closing the inner space towards the Yankee roll 1.

The air hood 3 contributes to the drying of the cellulose ply driven around the Yankee roll, as described below. The cellulose ply is into contact with the surface of the Yankee roll and the water contained therein evaporates due to the effect of the absorption of heat emitted from the Yankee roll 1. The emitted water vapor is removed by means of dry hot air inflated in the space between the air hood 3 and the cylindrical surface of the Yankee roll 1 through the outlets 7A of the inflate channels 7 and sucked through the hollow spaces or openings 9 and the suction duct 11.

The supply duct 5, the boxes 6 and the inflate channels 7 define a dry hot air supply circuit for each semi-hood 3A, 3B. The spaces or openings 9 between inflate channels 7, the hollow inner space of the semi-hoods 3A, 3B and the suction duct 11 define together a wet air suction circuit.

The temperature of the dry hot air supplied through each supply duct 5 is higher than the temperature of the wet air sucked through the openings or hollow spaces 9. As it will be better described below, to reduce the heat exchange between the air circulating in the supply ducts 5 and in the boxes 6 and the air sucked in the inner space of each semi-hood 3A, 3B through the spaces or opening 9, in some embodiments insulation coatings may be provided, covering at least partially the surfaces dividing the volumes where the dry hot air circulates from the volumes where the colder wet air circulates. This allows advantages in terms of energy savings and, on the other hands, in terms of greater uniformity in the temperature of the air inflated towards the Yankee roll 1, i.e. a reduced temperature gradient along the axial extension of said Yankee roll 1.

The inner space of each semi-hood 3A, 3B may be closed towards the outside by means of panels of thermal insulating material to form a thermal insulation indicated as a whole with 25, that can surround the whole surface, or a part, of each semi-hood 3A, 3B, leaving the area towards the Yankee roll 1 free of panels, i.e. the area where the inflate channels 7 and the hollow spaces 9 are located. Also in the area, where the two semi-bodies or semi-hoods 3A, 3B are adjacent to each other, there are no insulation panels. The thermal insulation 25 may be also provided for the front walls 3X of the two semi-hoods 3A, 3B, i.e. the walls orthogonal to the axis A-A of the Yankee roll 1 and to the channels 9.

In some embodiments, the thermal insulation is comprised of a plurality of adjacent insulation panels 31, fastened to a frame 13 and/or self-supporting, as better described below.

Each insulation panel may be made with a sheet or a plurality of plates of thermal insulating material, housed in a case formed by walls ad covers made for instance of sheet metal. The construction details of the insulation panels used for the outer insulation of the air hood will be detailed below.

Also a part of the walls delimiting the supply duct 5 and the boxes 6 may be provided with a thermal insulation to limit the heat losses towards the environment (in the segment of the supply duct 5 between the heat exchanger downstream, not shown, and the inside of the air hood 3) and towards the sucked wet air flow exiting the air hood (inside the air hood 3).

Figure 6:
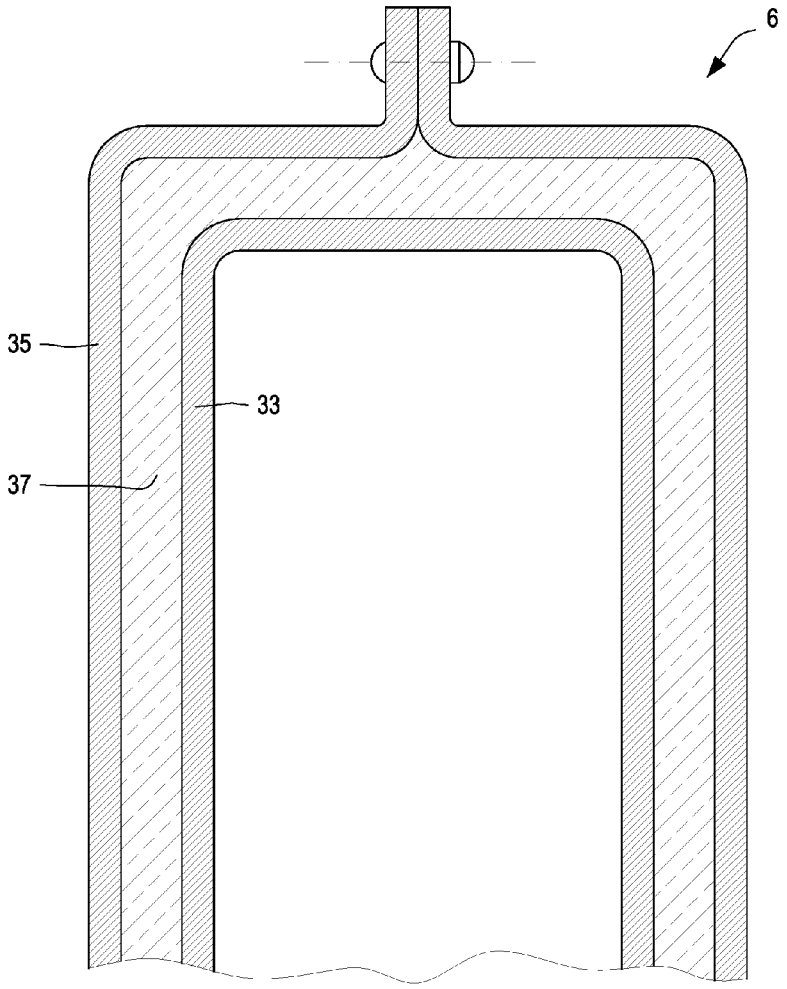
FIG. 6 is a local section according to VI-VI of FIG. 2 of a distribution box for the dry hot air.

FIG. 6 is a cross-section of a portion of a box 6. In this embodiment, the wall of the box 6 may have an inner metal sheet 33 and an outer metal sheet 35 forming an outer protective casing. A space is defined between the metal sheets 33 and 35, which is filled with a thermal insulating material 37. The thermal insulating material 37 may be comprised of sintered carbon foam with cell structure. The outer casing 35 protects the insulating material against the outer wet air sucked from the area where the cellulose ply passes towards the suction duct 11.

Figure 4:
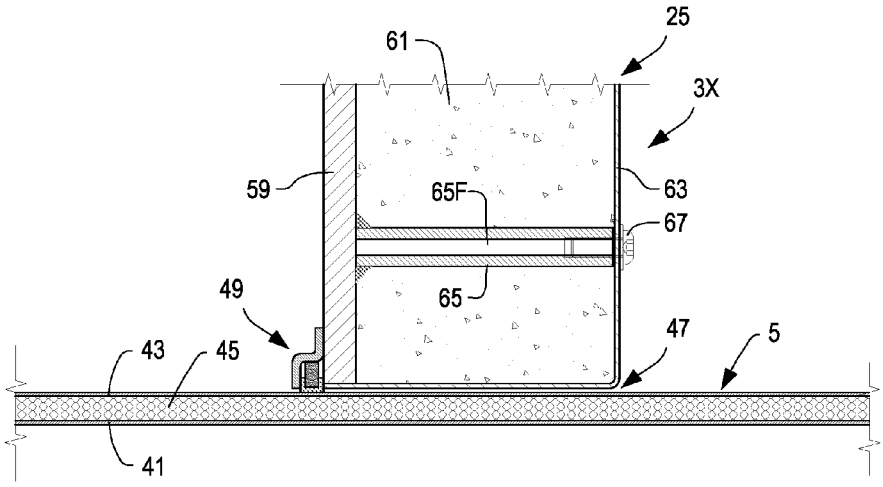
FIG. 4 shows a local section according to IV-IV of FIG. 2.

Similarly, the outer wall of each supply duct 5 may be thermally insulated. FIG. 4 shows a partial longitudinal cross-section of a portion of a supply duct 5 and the corresponding front wall 3X of the air hood 3 through which this supply duct 5 passes.

The supply duct 5 may comprise a substantially cylindrical wall 41 surrounded by an outer wall or casing 43. A space is defined between the two walls 41, 43, that can be filled with a thermal insulating material. In this case again, sintered carbon foam with cell structure may be used as thermal insulating material.

Advantageously, the front wall 3C of the air hood has a through hole 47, through which the supply duct 5 extends. To allow radial heat expansion of the supply duct 5 with respect to the front wall 3X, the hole 47 has a diameter greater than the outer diameter of the wall 43 protecting the insulation of the supply duct 5. A gasket 49 may be provided between the front wall 3X and the outer surface of the wall 43. In this way it is possible to avoid that, through the suction duct 11, environment air is sucked, penetrating in the inner volume of the hood 3 through the space between wall 43 and wall 3X.

Figure 5:
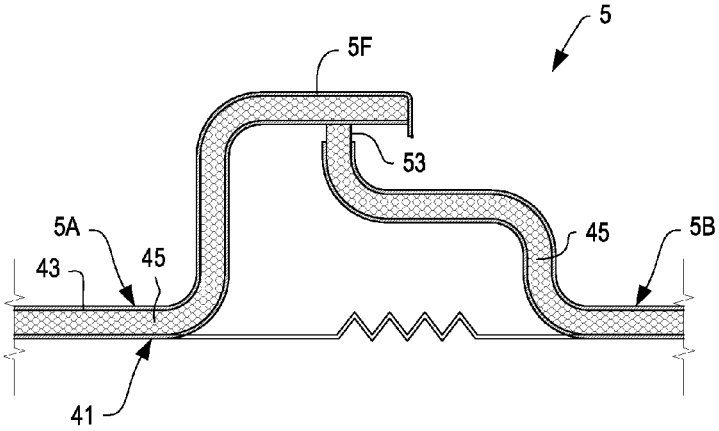
FIG. 5 is a longitudinal cross-section of the hot air supply duct in correspondence of an expansion joint.

To allow their axial expansion, on each supply duct 5 there is provided an expansion joint 51, shown in FIG. 5, illustrating a longitudinal cross-section of a portion of the dry hot air supply duct, arranged outside the air hood 3. The expansion joint 51 may be arranged between opposite ends of two portions 5A and 5B of the supply duct 5. The portion 5A may form a flange 5F outwardly surrounding the end of the opposite portion 5B, so that the end areas of the two portions 5A and 5B are partially overlapped axially in the area of the expansion joint 51. In addition to expansion joint 51, a seal 53 may be provided between the axially overlapped areas of the portions 5A and 5B.

Similar insulation systems and expansion joints may be provided on the suction ducts 11.

As schematically indicated in FIG. 4, the front wall 3X, and similarly the opposite front wall on the side opposite the connection side with the ducts 5 and 11, is provided with a thermal insulation 25. This may be comprised of sheets or plates of thermal insulating material 61 applied onto the outer surface of respective flanks 59 frontally delimiting the air hood 3. The sheets or plates of thermal insulating material 61 may be protected on the outside by means of a cover 63. This cover 63 may be for instance made of sheet metal, similarly to the flanks 59. FIG. 4 shows a detail of a fastening system for fixing the sheets of thermal insulating material 61 to the flanks 59. In this embodiment, fasteners 65, provided with a threaded hole 65F, are fixed, for instance welded, to the flank 59. A respective screw 67 engages each threaded hole 65F, by means of which the cover 63 is fastened to the flank 59, holding the sheet of thermal insulating material 61 between flank 69 and cover 63.

The described arrangement allows mounting one or more covers 63 onto the flank 59 of each front wall 3X, holding one or more sheets of thermal insulating material 61 inside the space between covers 63 and flank 59. The sheets or plates 61 of thermal insulating material may be provided with through holes for the fasteners 65, and the holes may be formed during manufacturing of the sheets or plates 61.

A curved side wall 3Y extends between the two front walls 3X that define the flank and the cover of each semi-hood 3A, 3B. The curved side wall 3Y may be formed by a plurality of insulation panels 31 aligned together. Each insulation panel 31 may flat and the whole curvature of the wall 3Y may be achieved by arranging the insulation panels 31 inclined with respect to one another, as shown in FIG. 2. Each insulation panel 31 is substantially shaped like a flat parallelepiped, with two greater sides, one corresponding to the distance between the front walls 3X and the other that can vary to better adjust the arrangement of the insulation panel 31 according to the whole curvature of the curved wall 3Y, as shown in FIG. 2. For instance, the insulation panels 31 arranged around the ducts 5 and 11 are shorter to follow the high curvature of the wall 3Y in this area, whilst they have a greater length on the sides.

Figure 7:
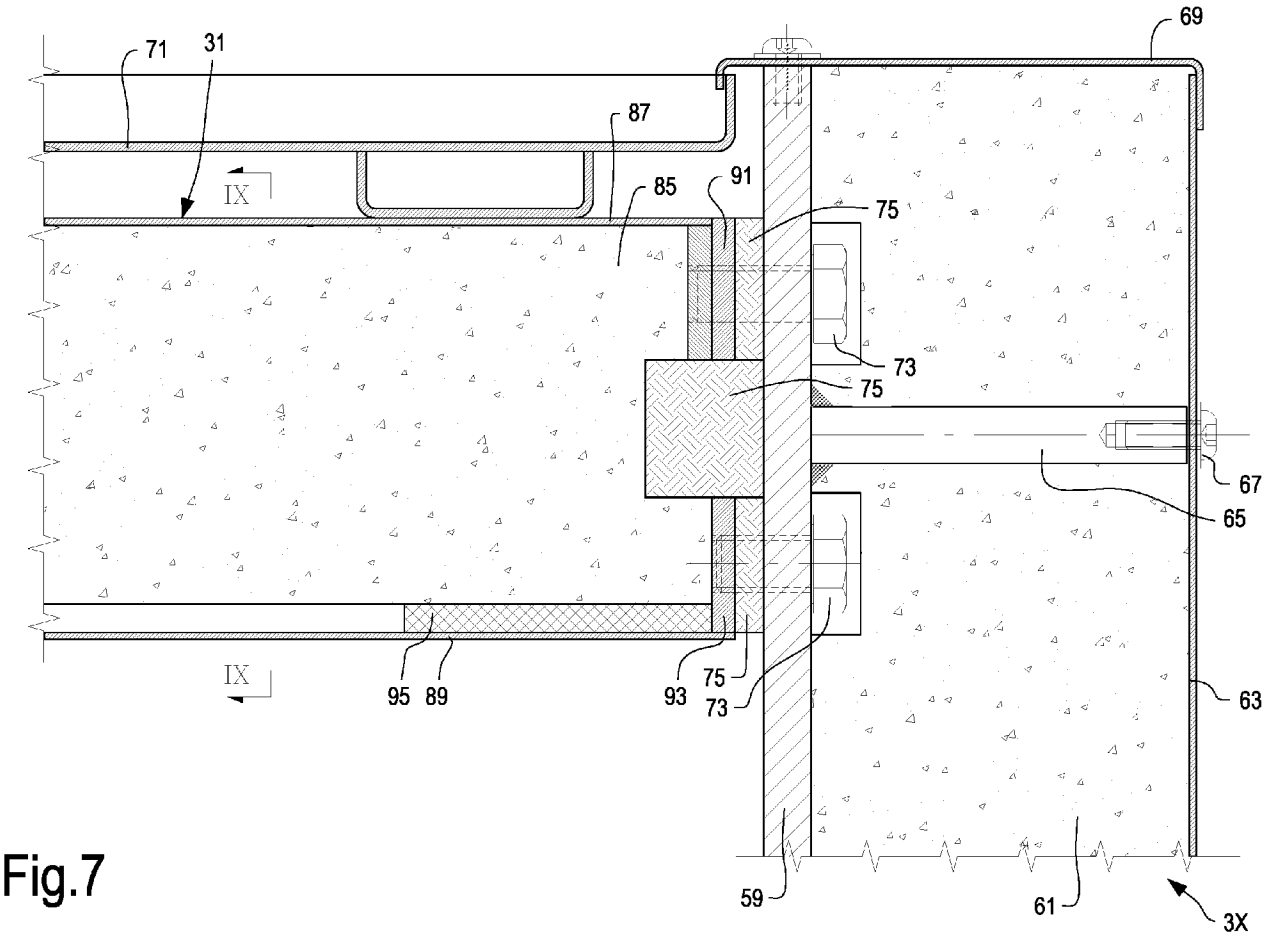
FIGS. 7 and 8 show enlargements of the areas indicated with VII and VIII where the insulation panels of the side wall are joined to the front wall of the air hood.
Figure 8:
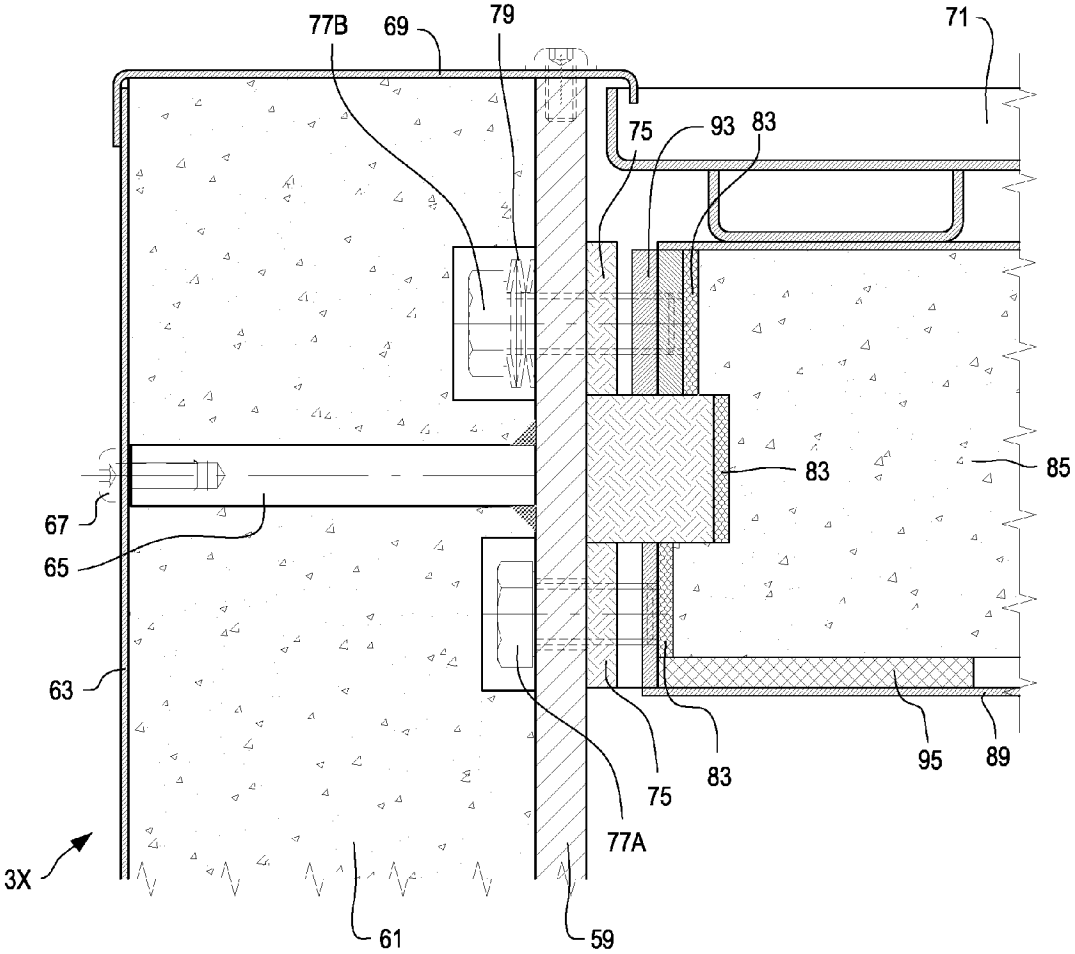
Figure 9:
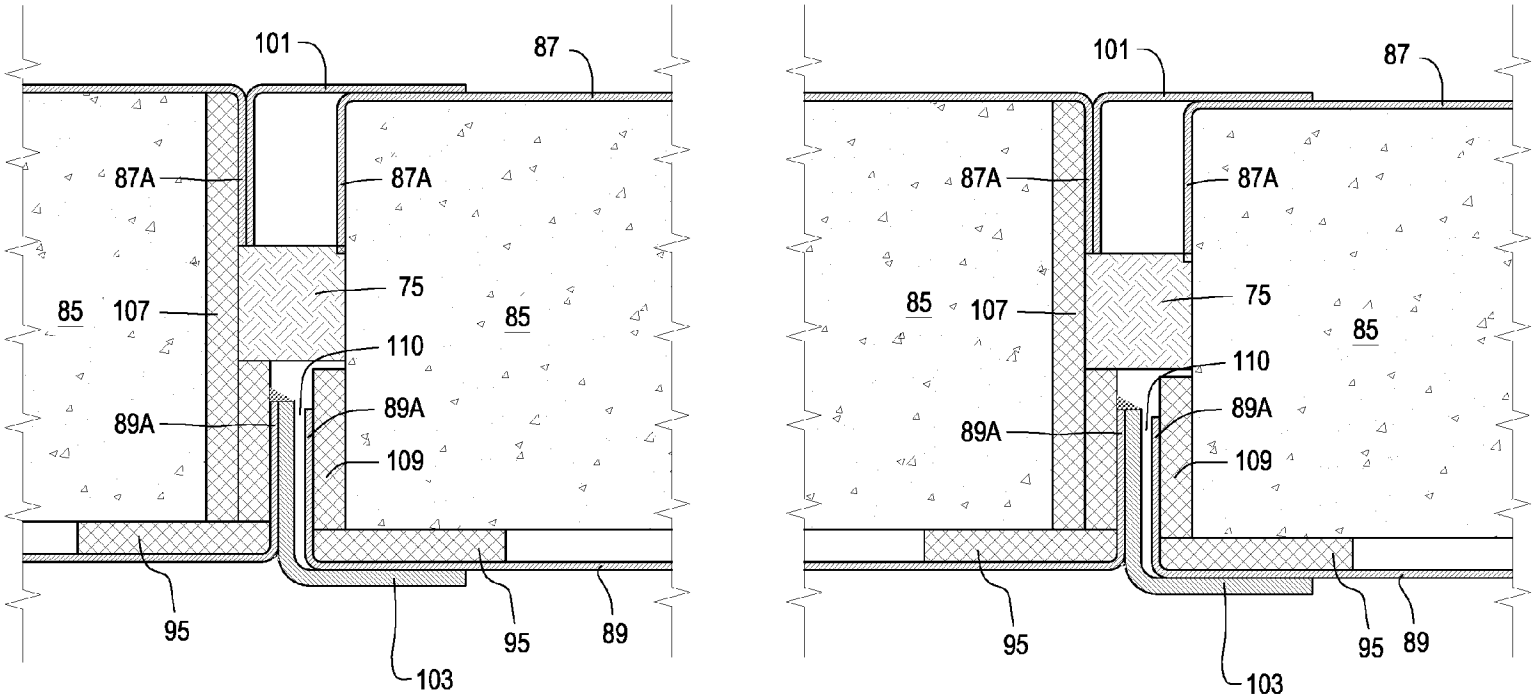
FIG. 9 is a longitudinal cross-section to IX-IX of FIG. 7 of an insulation panel according.

The insulation panels 31 may be connected to the front walls 3X of each semi-hood 3A, 3B as shown in FIGS. 7 and 8. FIG. 9 shows a longitudinal cross-section of an insulation panel 31 according to IX-IX of FIG. 7.

FIGS. 7 and 8 show a protective sheet metal 69 covering at the top the plates of thermal insulating material 61 of the walls 3X. A gutter 71 is also shown, fixed to the insulation panels 31, for collecting the wash water used in a known manner for removing the deposits of cellulose fibers.

With reference to FIGS. 7, 8 and 9, the insulation panels may be fastened between the front walls 3X as described below. On a side (for instance the side illustrated in FIG. 7) each panel 31 may be fastened to the flank 59 by means of screws 73. A sealing system 75 may be interposed between the surface of the flank 59 facing the inside of the air hood 3 and the edge of the insulation panel 31. This sealing system may be comprised of a high-temperature gasket, for instance made of graphitized glass fiber. The seal 75 may extend around the whole perimeter of the panel 31.

On the opposite side, illustrated in FIG. 8, the insulation panel 31 may be fastened to the flank 59 by means of a pair of screws 77A, 77B. The screw 77B may be associated with an elastic system, for instance comprising Belleville springs 79 to allow differential heat expansion between outer side and inner side of the insulation panel 31. This differential heat expansion may entail a bending of the panel 31 which is allowed by the presence of the yieldability of the elastic system 79. Also on this side a sealing system 75 may be provided between the edge of the insulation panel 31 and the flank 59, for instance providing a seal surrounding the whole panel.

In some embodiments, a sheet 85 of thermal insulating material may be provided inside the insulation panel 31. This sheet may be made of the same insulating material of which are made the sheets or plates 61 surrounding the front walls 3X. Some examples of materials and production methods will be described below.

The sheets or plates of thermal insulating material 85 may be contained in a case, shell or housing space, delimited on the main faces by covering sheet metals 87 and 89 that are respectively outside and inside the air hood 3. The covering sheet metals 87 and 89 of each insulation panel 31 may be made of steel and form the case or shell for housing the sheets or plates of thermal insulating material 85 together with the side seal 75 and with longitudinal banks or edges 91, 93.

In some embodiments, pads or strips 95 of a different material, for instance with higher elasticity and compressibility, may be arranged between the inner cover 89 and the sheet of thermal insulating material 85. The pads or strips 95 may be for instance made of sintered carbon foam.

As shown in FIG. 9, the insulation panels 31 may be mounted adjacent to one another to form a substantially continuous insulation along the curved wall 3Y. the two covers 87, 89 may have bent edges 87A, 89A parallel to the axis A-A of the Yankee roll 1, with which the air hood 3 is associated. An angular profile 101 may be applied along one of the bent edges 87A of the cover 87, whilst an angular profile 103 may be applied along the corresponding bent edge 89A of the cover 89.

The angular profile 103 of each insulation panel 31 acts as a support for the adjacent insulation panel 31 and the angular profile 101 defines, together with the angular profile 103, a channel for reciprocal joining of the two adjacent insulation panels 31. Practically, the angular profiles 101 and 103 define reciprocal fastening members to join consecutive insulation panels 31 together. In this way it is possible to join together the insulation panels 31, one following the other, to form the insulation of the wall 3Y.

The seals 75 may extend between the bent edges 87A, 89A; in this way these seals may surround the whole sheet or plate of thermal insulating material 85.

Strips 107, 109 of a different thermal insulating material, for instance a more compressible material, may be inserted between the bent edges 87A, 89A and the sheets or plates of thermal insulating material 85. Typically, the strips 107, 109 may be made for instance of sintered carbon foam, to allow differential heat expansions between the sheets of thermal insulating material 85 and the covers 87, 89.

Adjacent and consecutive insulation panels 31 may be mounted keeping a space 110 therebetween, thus allowing heat expansion.

The sheets or plates of thermal insulating material 61, 85 forming the thermal insulating coatings of the front walls 3X and filling the insulation panels 31 may be formed separately and then applied to the flank 59 and to one of the covers 87, 89 of the panel 31 respectively. In other embodiments, the plates of thermal insulating material 61, 85 may be produced by pouring a liquid onto the flank 59 or onto one of the covers 87, 89 and then hardening the thermal insulating material.

In some embodiments, the thermal insulating material forming the sheets or plates 61 and 85 may be comprised of a polymeric matrix comprising one or more of the following fillers: glass spheres, rock wool fibers and clay particles, montmorillonite particles.

Advantageously, in some embodiments the glass spheres have a dimension comprised between 5 micrometers and 100 micrometers, for instance between 5 and 60 micrometers, based upon the percent composition of the material.

In some embodiments, the rock wool fibers may have a cross dimension—intended as the maximum dimension of the cross-section—comprised between 2 and 6 micrometers. In case the fibers have round cross-section, this dimension refers to the diameter. The length of the rock wool fibers may be comprised between 5 and 70 micrometers, depending upon the percent composition of the material.

The numbers mentioned above have been given just by way of example and, even if they may be preferred in some embodiments, however they do not limit the scope of the invention.

Generally, the rock wool is an amorphous silicate in the form of thin filaments obtained from siliceous rocks.

The polymeric matrix may contain or be substantially constituted by an acrylic polymer, for instance an acrylic polymer with polar functional groups, to have adhesive features. In some embodiments the acrylic polymer may be an acrylic acid copolymer with acililates and methacrylates with different alkyl chain lengths.

In some embodiments the polymer may be a thermoplastic polymer of long hydrocarbon chain with polar functional groups.

In some embodiments, phosphor compounds and/or nanostructured clays may be added to the polymeric matrix. The phosphor compound may be chosen among the flame-retardant compounds, for instance an alkyl or aromatic phosphonate.

Clay particles and/or montmorillonite particles may have nanoscale sizes, in particular comprised between 5 and 100 nanometers, preferably between 5 and 50 nanometers and more preferably between 5 and 20 nanometers, based upon the percent chemical composition.

In some embodiments the insulating material may be produced starting from a composition having a dry percent composition by weight comprising:

glass spheres 5-40% by weight;

rock wool 5-40% by weight;

clay and/or montmorillonite 0.5-5% by weight polymer, for instance acrylic polymer, 10-40% by weight.

A liquid dispersing agent may be added to this composition, such as water or another dispersor that can be easily vaporized and has low environmental impact. The function of the dispersing liquid is to adjust the viscosity of the material before distributing it on adequate structures or equipment, to form a layer of material that is then heated and solidified.

The sheets or plates of thermal insulating material may be formed starting from a suspension, in water or other dispersing liquid, of the polymer and the inorganic components indicated above. The suspension is applied onto a support of adequate shape, according to the final use of the sheet or plate. The layer is then solidified and hardened in a furnace. Once ready, the sheets or plates may be cut or shaped, if necessary, and then applied onto the sides 59 and/or the cover 87 or 89 of the single insulation panel 31. Alternatively, the sheet or plate may be produced by pouring the material directly onto the plate 59 for the insulation of the front walls 3X, or on one of the covers 87, 89 forming the shell surrounding the thermal insulating material 85 for the insulation panels 31.

In some embodiments, the thickness of the thermal insulating material forming the plates 61 and 85 may be advantageously comprised between 20 and 60 mm.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. An air hood for Yankee rolls, comprising:

at least one supply circuit to supply dry hot air towards outlets to a working area, wherein the at least one supply circuit comprises at least a supply duct, dry hot air distribution boxes in fluid communication with the supply duct, and inflate channels for supplying dry hot air in the working area of the air hood, said inflate channels being in fluid communication with the distribution boxes and said inflate channels being provided with said outlets; and at least one suction circuit to suck wet air from the working area, wherein the suction circuit comprises an inner space inside the air hood and at least a suction duct in fluid communication with the inner space, wherein the distribution boxes and at least a portion of the supply duct are arranged in the inner space, the distribution boxes having side walls separating an interior of the distribution boxes from the inner space and the distribution boxes being provided with a thermal insulation arranged on the side walls for at least partially insulating the inner space from the interior of the distribution boxes.

2. An air hood according to claim 1, wherein the inflate channels are arranged according to a substantially cylindrical surface, delimiting the inner space of the air hood along the working area which is to face the cylindrical surface of a Yankee cylinder, the inflate channels being spaced from one another to define passages therebetween, through which wet air is sucked from the working area, where a cellulose ply passes, towards the inner space of the air hood and from said inner space of the air hood towards the suction duct.

3. An air hood according to claim 2, wherein the suction circuit comprises openings between the inflate channels in fluid communication with the inner space of the air hood, wherein a heat exchange between the interior of the distribution boxes and the suction circuit is reduced via the thermal insulation.

4. An air hood according to claim 3, wherein the supply duct is provided with said thermal insulation, wherein an outer wall defines the supply duct, the thermal insulation surrounding the outer wall, the outer wall being thermally insulated from at least the at least one suction circuit via the thermal insulation.

5. An air hood according to claim 2, wherein the supply duct is provided with said thermal insulation, wherein an outer wall defines the supply duct, the thermal insulation surrounding the outer wall, the outer wall being thermally insulated from at least the at least one suction circuit via the thermal insulation.

6. An air hood according to claim 2, further comprising a first semi-hood and a second semi-hood, each of said first semi-hood and said second semi-hood comprising a respective supply circuit for supplying said dry hot air and a respective suction circuit for sucking said wet air.

7. An air hood according to claim 1, wherein the suction circuit comprises openings between the inflate channels in fluid communication with the inner space of the air hood, wherein a heat exchange between the interior of the distribution boxes and the suction circuit is reduced via the thermal insulation.

8. An air hood according to claim 7, wherein the supply duct is provided with said thermal insulation, wherein an outer wall defines the supply duct, the thermal insulation surrounding the outer wall, the outer wall being thermally insulated from at least the at least one suction circuit via the thermal insulation, wherein a transfer of heat is reduced between the supply duct and at least an interior of the at least one suction circuit via the thermal insulation.

9. An air hood according to claim 1, wherein the supply duct is provided with said thermal insulation, wherein an outer wall defines the supply duct, the thermal insulation engaging the outer wall, the outer wall being thermally insulated from at least the at least one suction circuit via the thermal insulation.

10. An air hood according to claim 1, further comprising a first semi-hood and a second semi-hood, each of said first semi-hood and said second semi-hood comprising a respective supply circuit for supplying said dry hot air and a respective suction circuit for sucking said wet air.

11. An air hood according to claim 10, wherein each supply circuit comprises a dry hot air supply duct in fluid communication with a plurality of respective dry hot air distribution boxes provided with said thermal insulation, wherein the distribution boxes of each of said first semi-hood and said second semi-hood are in fluid communication with a plurality of respective inflate channels that supply air towards the working area and said plurality of respective inflate channels are provided with outlets for the dry hot air towards the working area of the air hood.

12. An air hood according to claim 11, wherein each suction circuit comprises a semi-hood inner space and a suction duct.

13. An air hood according to claim 1, further comprising two front walls substantially orthogonal to an axis of a Yankee roll when the air hood is associated with the Yankee roll, at least one of said front walls being provided with passages for one or more of the supply duct and the suction duct.

14. An air hood according to claim 13, wherein the front walls are provided with said thermal insulation.

15. An air hood according to claim 14, wherein the thermal insulation of the front walls comprises sheets or plates of thermal insulating material fastened to support flanks.

16. An air hood according to claim 15, wherein one or more of the sheets or plates of thermal insulating material comprises a thermal insulating material with a polymeric matrix, where one or more of the following components are dispersed: glass particles, rock wool, clay particles, montmorillonite particles.

17. An air hood according to claim 16, wherein a hollow space inside the thermal insulating material is lower than 10%, preferably lower than 3% and more preferably lower than 2% of a whole volume thereof.

18. An air hood according to claim 15, wherein at least one side wall is provided between the two front walls, the at least one side wall being provided with said thermal insulation.

19. An air hood according to claim 14, wherein at least one side wall is provided between the two front walls, the at least one side wall being provided with said thermal insulation.

20. An air hood according to claim 13, wherein at least one side wall is provided between the two front walls, the at least one side wall being provided with said thermal insulation.

21. An air hood according to claim 20, wherein the at least one side wall comprises a plurality of insulation panels forming the thermal insulation.

22. An air hood according to claim 21, wherein each of said insulation panels comprises two outer covers, between which at least one sheet or plate of thermal insulating material is arranged.

23. An air hood according to claim 22, wherein a sealed space is provided between the two outer covers, inside which said at least one sheet or plate of thermal insulating material is housed.

24. An air hood according to claim 22, wherein reciprocal fastening members are arranged between consecutive insulation panels to join said insulation panels together.

25. An air hood according to claim 24, wherein said insulation panels are mounted with a reciprocal clearance to allow heat expansion.

26. An air hood according to claim 24, wherein said insulation panels are fastened to the two front walls so as to allow the heat expansion of said insulation panels.

* * * * *